US007051452B2

(12) United States Patent
Brooks

(10) Patent No.: US 7,051,452 B2
(45) Date of Patent: May 30, 2006

(54) FOOT SCANNING AND MEASUREMENT SYSTEM AND METHOD

(75) Inventor: Jeffrey S. Brooks, St. Louis County, MO (US)

(73) Assignee: Jeffrey S. Brooks, Inc., Creve Coeur, MO (US)

( * ) Notice: Subject to any disclaimer, the term of this patent is extended or adjusted under 35 U.S.C. 154(b) by 0 days.

(21) Appl. No.: 10/685,059

(22) Filed: Oct. 14, 2003

(65) Prior Publication Data

US 2004/0081336 A1 Apr. 29, 2004

Related U.S. Application Data

(60) Provisional application No. 60/418,995, filed on Oct. 16, 2002.

(51) Int. Cl.
*A61B 5/107* (2006.01)

(52) U.S. Cl. ..... 33/515; 33/227

(58) Field of Classification Search ..... 33/515, 33/227, 228, 512; 382/307, 317, 203
See application file for complete search history.

(56) References Cited

U.S. PATENT DOCUMENTS 2,399,424 A * 4/1946 Bliss ..... 378/192
3,328,882 A * 7/1967 Blivice ..... 33/3 C
3,457,647 A 7/1969 Cohen
4,064,641 A * 12/1977 Levine ..... 36/1.5
4,395,826 A * 8/1983 Bidegain et al. ..... 33/3 C
D280,300 S * 8/1985 Short ..... D10/71
4,662,079 A 5/1987 Graf et al.
5,025,476 A * 6/1991 Gould et al. ..... 382/115
5,128,880 A 7/1992 White
D329,322 S * 9/1992 Wartell ..... D2/898
5,195,030 A 3/1993 White
5,206,804 A 4/1993 Thies et al.
5,216,594 A 6/1993 White et al.
5,237,520 A 8/1993 White
5,339,252 A 8/1994 White et al.
5,477,371 A 12/1995 Shafir
5,687,467 A 11/1997 Bergmann et al.
5,729,905 A * 3/1998 Mathiasmeier et al. ..... 33/3 R
5,790,256 A * 8/1998 Brown et al. ..... 356/613

(Continued)

FOREIGN PATENT DOCUMENTS

FR 2652995 A1 * 4/1991

(Continued)

OTHER PUBLICATIONS

International Search Report, Feb. 25, 2004, 4 pages.

*Primary Examiner*—G. Bradley Bennett
(74) *Attorney, Agent, or Firm*—Senniger Powers

(57) ABSTRACT

A system and method for measuring the size of a person's foot so that properly sized shoes can be selected. The measuring system has a support surface having a transparent window, and a fixture positioned over the transparent window for receiving a foot to be scanned. The measuring system also includes an imaging device for scanning the foot in the fixture through the window to produce an image of a bottom surface of the foot superimposed on foot measuring indicia. In one embodiment, the fixture is shaped like a shoe. The person can print the image and use the image to select a properly sized pair of shoes.

22 Claims, 5 Drawing Sheets

U.S. PATENT DOCUMENTS

| | | | | |
|---|---|---|---|---|
| 5,911,126 | A | 6/1999 | Massen | |
| 6,006,412 | A | 12/1999 | Bergmann et al. | |
| 6,141,889 | A | 11/2000 | Baum | |
| 6,549,639 | B1 * | 4/2003 | Genest | 382/100 |
| 2002/0035793 | A1 | 3/2002 | Byrd | |

FOREIGN PATENT DOCUMENTS

| | | | |
|---|---|---|---|
| GB | 2 236 862 | A | 4/1991 |
| WO | WO 03/036413 | A2 | 5/2003 |
| WO | WO 03/036413 | A3 | 5/2003 |

* cited by examiner

FOOT SCANNING AND MEASUREMENT SYSTEM AND METHOD

CROSS REFERENCE TO RELATED APPLICATION

This application claims the benefit of U.S. Provisional Application Ser. No. 60/418,995, filed Oct. 16, 2002, titled FOOT SCANNING AND MEASUREMENT SYSTEM AND METHOD.

BACKGROUND OF THE INVENTION

This invention relates in general to a foot measuring system, and more particularly, to a system for scanning an image of a foot and displaying the image with a measuring scale.

Correctly fitted footwear increases the comfort of the wearer and can prevent long term foot problems. It is well recognized that one's foot size changes with age, weight changes, and other factors. In fact, children and teenagers typically grow one to three foot sizes each year. Therefore, people should measure their feet each time they purchase shoes to ensure they purchase correctly sized footwear. Additionally, there are other places where one needs to measure foot size in order to obtain properly fitting footwear, such as when renting bowling shoes, ice skates, ski boots, and other specialized sporting equipment.

Correctly measuring someone's foot size often requires the assistance of knowledgeable sales people. In busy retail shoe stores, it may be impractical to hire sufficient sales people to be available to measure a customer's foot size in a timely manner. This is a source of frustration for some customers who would like to know their correct shoe size before beginning the search for a pair of shoes. Often, having the customer measure his or her own foot is not a desirable solution because conventional foot measuring devices are time consuming and can be confusing to interpret for those unfamiliar with their use, thus producing the possibility of inaccurate results. Additionally, small children may not want to have their feet measured using conventional devices.

SUMMARY OF THE INVENTION

In one embodiment, the invention relates to a system for measuring the size of a person's foot. The measuring system has a support surface comprising an opening, and a fixture positioned over the opening for receiving a foot to be measured. The measuring system also comprises an imaging device positioned relative to the opening for scanning the foot in the fixture through the opening to produce an image of a bottom surface of the foot superimposed on foot measuring indicia. In one embodiment, the fixture is shaped like a shoe and a transparent window covers the opening. Foot measuring indicia are imprinted on the window.

In another embodiment, the invention is directed to a method for measuring the size of a person's foot. The method comprises the steps of placing the foot of a person into a fixture positioned over a transparent window and scanning a bottom surface of the foot through the window to produce an image of the foot superimposed on foot measuring indicia. The method further includes printing the image.

Another embodiment of the invention is directed to a method for obtaining a properly sized pair of shoes. The method includes the steps of placing the foot of a person into a fixture positioned over a transparent window, and scanning a bottom surface of the foot through the window to produce an image of the foot superimposed on foot measuring indicia. The method further includes printing the image and using the image to select a properly sized pair of shoes.

In yet another embodiment, the invention is directed to a system for measuring the size of a foot. The measuring system includes a platform comprising a support surface having an opening therein. The measuring system also includes an imaging device positioned relative to the opening to produce an image of a bottom surface of the foot superimposed on foot measuring indicia. The measuring system also includes an actuator on the platform for operating the imaging device.

BRIEF DESCRIPTION OF THE DRAWINGS

Corresponding reference characters indicate corresponding parts throughout the several views of the drawings.

DETAILED DESCRIPTION OF PREFERRED EMBODIMENTS

Figure 1:
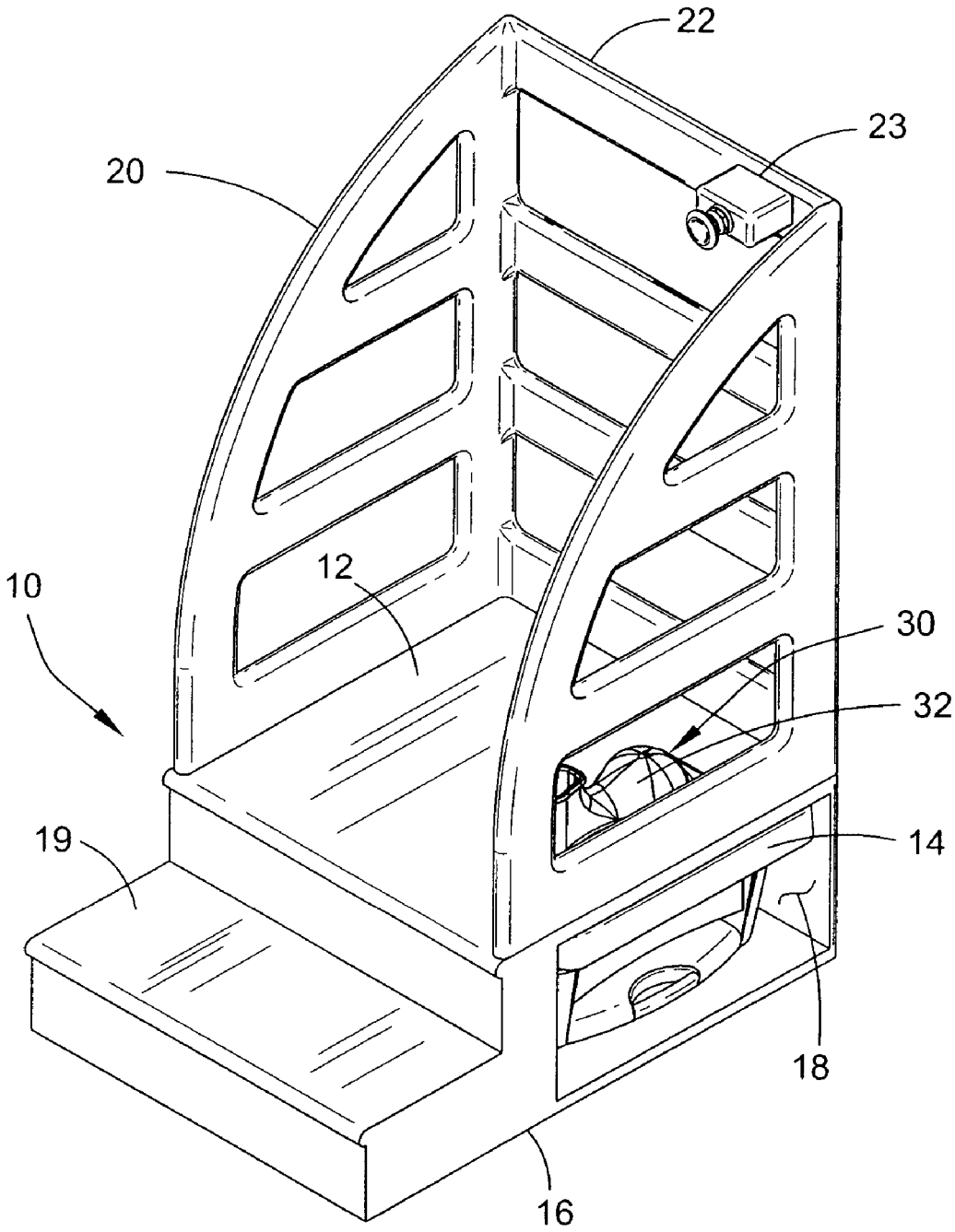
FIG. 1 is a perspective view of one embodiment of a foot measuring system of this invention.
Figure 2:
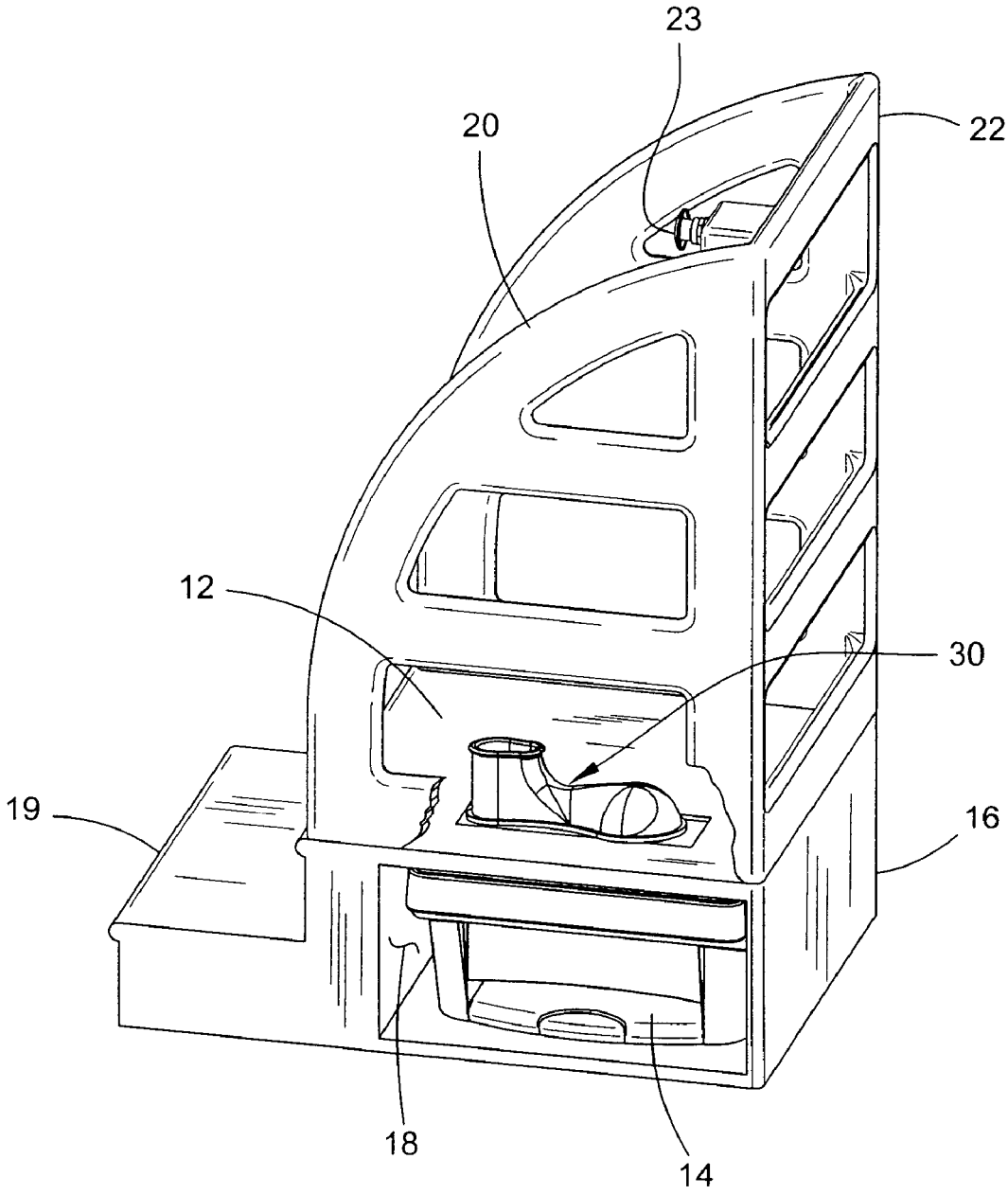
FIG. 2 is a side perspective view of the foot measuring system of FIG. 1 showing the placement of an imaging device.

Referring now to the drawings, and in particular to FIG. 1, one embodiment of a measuring system used for measuring the foot of a person incorporating features of this invention is indicated in its entirety by the reference numeral 10. The measuring system 10 is suitably located in a shoe store (or the shoe department of a department store) so that a customer can obtain an accurate measurement of his or her foot and purchase the proper size of shoes. However, it is contemplated that the measuring system 10 can also be used at any location where a person needs to measure the size of his or her foot, such as, for example, bowling alleys, skating rinks and the like. The measuring system 10 comprises a support surface 12 and a foot imaging device 14. In one embodiment, the support surface 12 is positioned on a raised platform 16 with the foot imaging device 14 placed in a cavity 18 under the raised platform so that the support surface is located above the foot imaging device 14. Optionally, the platform 16 may have one or more steps 19 enabling a person to stand on the support surface 12. Alternately, the support surface 12 can be placed over a cavity in the floor (not shown) which contains the foot imaging device 14 such that a raised platform is not needed.

The support surface 12 and raised platform 16 are suitably made of wood and are capable of supporting the weight of a person standing on the support surface 12. However other materials, such as metal, fiberglass, plastic and the like suitable for supporting a person are also contemplated without departing from the scope of the invention. The raised platform 16 has a handrail 20 and a front railing 22 to provide support for the person standing on the platform 16. Optionally, operating buttons 23 and other devices (not shown) such as mirrors, horns, and decorative devices, such as devices to attract a child's attention, are placed on the handrails 20 and/or front railing 22.

The foot imaging device 14 is suitably a conventional optical scanner, such as model number 750c or 750xi commercially available from Hewlett-Packard Company of Palo Alto, Calif. It will be appreciated by those skilled in the art that other scanning devices may be substituted for the particular scanner specified above without departing from the teachings of the invention. Alternately, a photographic camera, such as a digital camera with a wide angle lens, can be used to produce an image of the foot. The foot imaging device 14 produces an image, such as a scanned image (such as that shown in FIG. 5), of the foot of the person standing on the support surface 12. Suitably, the imaging device 14 can be adjusted to accommodate various conditions, such as a foot with light or dark skin tones or a foot wearing a light-colored or dark-colored sock by varying the intensity of a light source (not shown) used in the scanning process which is directed at the foot being scanned. Operating buttons 23 configured to operate the imaging device 14 are conveniently positioned, such as on the front railing 22. Those of ordinary skill in the art will readily appreciate the construction and operation of imaging devices such as optical scanners and digital cameras. Accordingly, additional details of construction and operation of the imaging device 14 will not be described herein.

Figure 3:
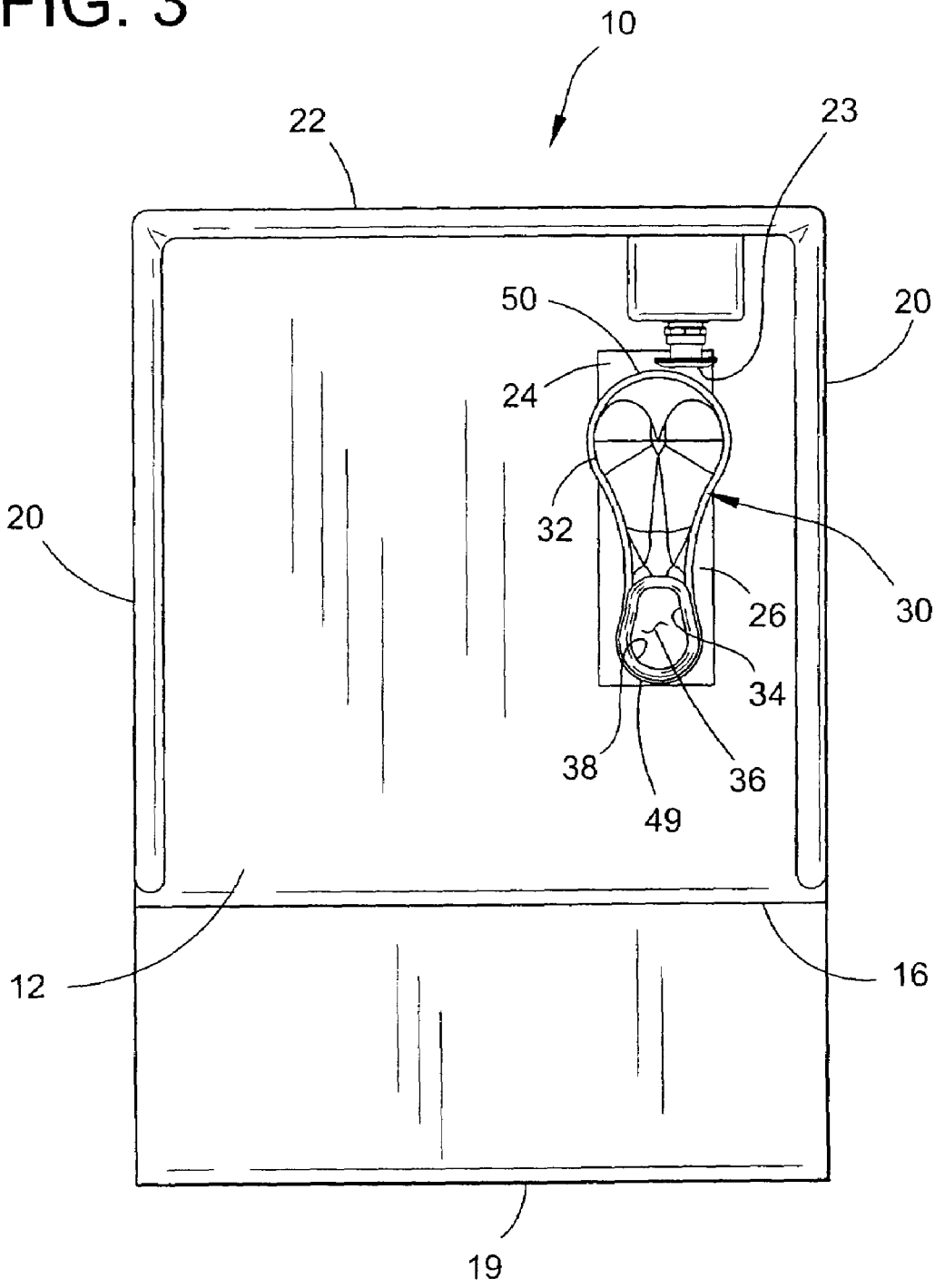
FIG. 3 is an overhead view of the foot measuring system showing an opening in a support surface and a fixture over the opening.
Figure 4:
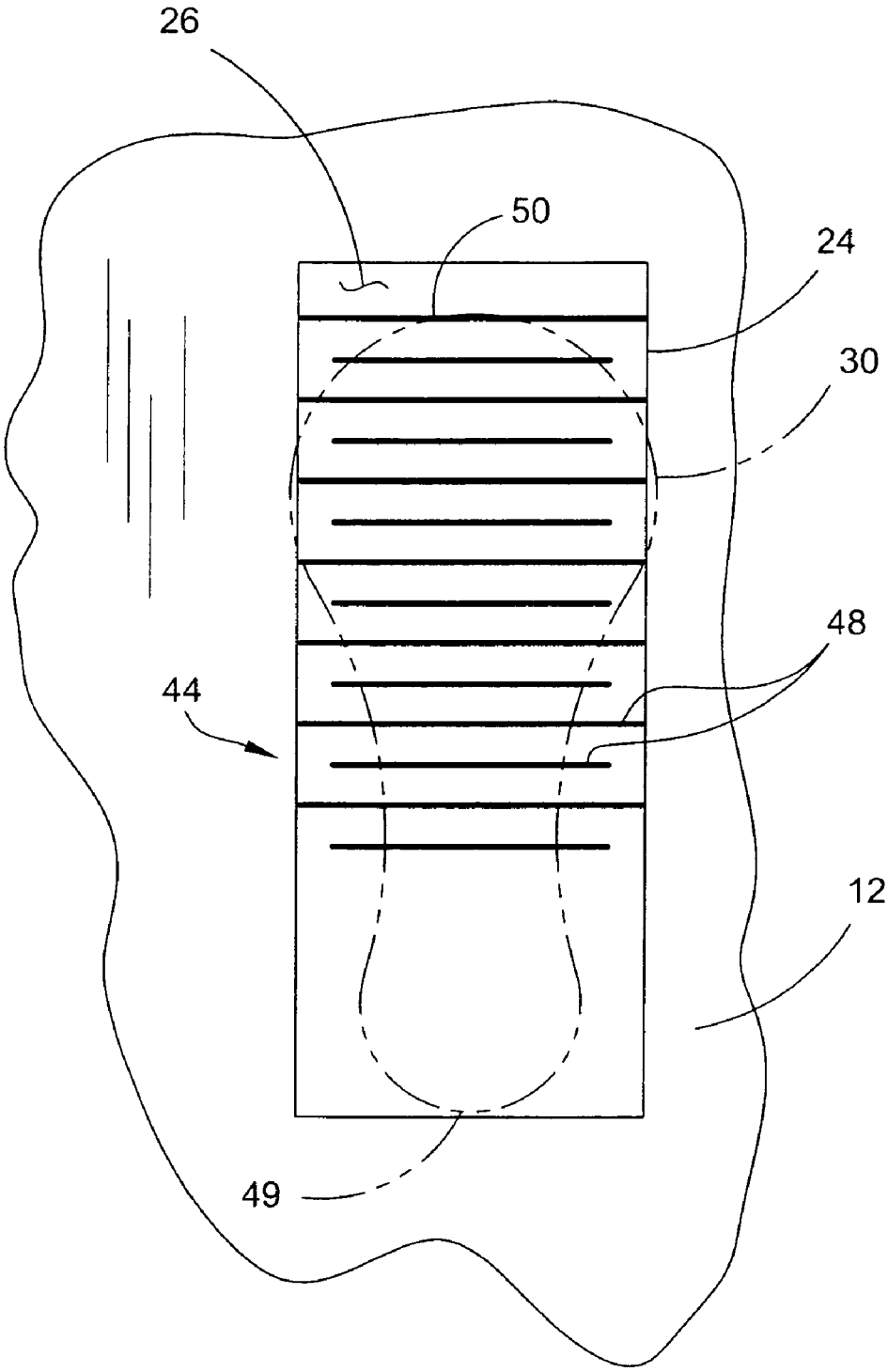
FIG. 4 is an enlarged cutaway view of a portion of the foot measuring system illustrating measuring indicia.

Referring now to FIGS. 3 and 4, the support surface 12 has an opening 24 therein. The imaging device 14 is positioned relative to the opening 24 such that when the person stands on the support surface 12 with his or her foot placed over the opening, the foot imaging device scans the underside of the person's foot to produce an image. In the particular embodiment shown, the opening 24 is positioned directly over the imaging device 14, but other arrangements may be suitable. Also, the opening 24 shown in FIGS. 3 and 4 is rectangular in shape, but other shapes, such as, for example, square, oval, round or the general shape of a human foot can be used. The opening 24 has a length between about 6 and about 20 inches and a width between about 3 and about 12 inches, suitably a length between about 10 and about 18 inches and a width between about 3.5 and about 10 inches, and even more suitably a length of about 16 inches and a width of about 4 inches. A transparent window 26 is disposed over the opening 24. The window 26 is made of plexiglass, but other suitable transparent or semi-transparent materials capable of supporting the weight of a person standing on the support surface 12, such as glass, can be used without departing from the scope of the invention. As illustrated in FIGS. 3 and 4, the window 26 is located in the support surface 12 in registration with the foot imaging device 14 such that the foot imaging device scans an image of the foot supported on the window 26. Alternately, the opening 24 may have a grid of bars (not shown) to support the foot, and the foot imaging device 14 scans through the grid of bars. The support surface 12 may have any configuration that enables a person to place their foot adjacent the foot imaging device 14. For example, the support surface 12 can be generally vertical or at an angle such that a person places his or her foot against the window 26 from a sitting position.

The measuring system 10 also desirably includes a fixture, indicated generally at 30, on the support surface 12 positioned over the window 26. In one embodiment, the fixture 30 is in the form of a shoe and has a shoe upper 32 having a mouth 34 leading to an interior cavity 36 within the shoe upper 32. It is preferred that the shoe upper 32 have a configuration which would encourage a child to insert his or her foot into the fixture 30 so that the foot can be measured. For example, in one embodiment, the shoe upper 32 is a multicolored clown shoe. However, it will be appreciated that the configuration of the shoe upper 32 is not per se critical and that any of many types of shoe uppers 32 can be used. For example, the shoe upper 32 can be in the form of a boot, tennis shoe, or a slipper. Additionally, the shoe upper 32 can be in the shape of an animal foot or any other shape capable of receiving a foot. The mouth 34 is sized and located so that a foot can be inserted into the cavity 36 and positioned on the window 26. Additionally, the shoe upper 32 may have a hinged portion (not shown) or laces to facilitate insertion of the foot into the fixture 30. Suitably, the fixture 30 has a cuff 38 or sliding ring that fits snugly against the ankle or leg of the person whose foot is placed within the cavity 36. The cuff 38 is configured to substantially prevent ambient light from entering the cavity 36 when the persons foot in inserted into the fixture 30.

FIG. 4 is an enlarged view of the opening 24 with the fixture 30 removed (but outlined in phantom) for clarity. The transparent window 26 has foot measuring indicia indicated generally at 44 which, in a suitable embodiment, is a measuring scale. Suitably, the measuring scale 44 includes foot measuring indicia for the length and/or the width (not shown) of the foot. In one embodiment, the measuring scale 44 is produced by a series of transverse lines or markers 48 imprinted on the window 26. The transverse lines 48 are scaled according to any foot sizing method including, for example, the Brannock measuring system, to determine the size of the person's foot. In one embodiment, the transverse lines 48 are spaced at longitudinal intervals on the window 26 beginning near a rearward heel portion 49 of the shoe upper 32 and ending under a toe portion 50 of the shoe upper 32. Alternately, lines or other measuring indicia can be imprinted on a surface of the imaging device 14, or the imaging device 14 can use a printing medium with scaled lines or other measuring indicia preprinted thereon.

Figure 5:
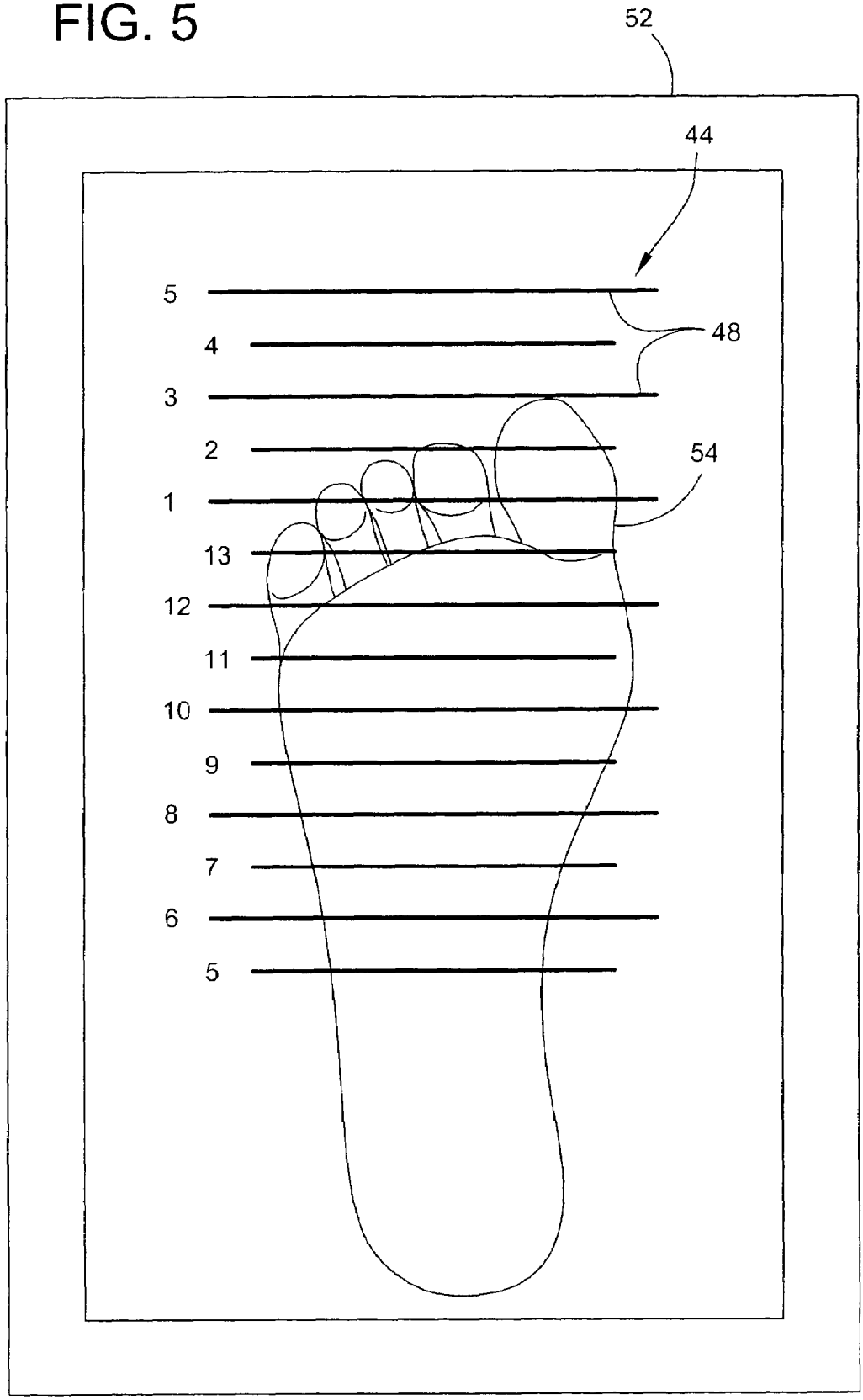
FIG. 5 is an example of a printout from the imaging device of the foot measuring system of FIG. 1.

FIG. 5 illustrates an exemplary printout 52 produced by the imaging device 14 of FIG. 1. As shown, the imaging device 14 produces the printout 52 with an image 54 of the person's foot along with the measuring indicia 44. The scanned image 54 may be displayed in a plurality of colors, or varying shades of a single color, or in other formats. Suitably, the printout 52 displays the image 54 on a 1:1 scale ratio with the person's foot, however, other ratios may be used. The person can use the printout 52 to determine, for example, the proper size of shoes to purchase or request. Additionally, the foot imaging device 14 can print other information (not shown) on the reproduction, such as decorative figures, the person's name, the date, the location where shoes of different sizes and styles are located within the shoe store or other information. Desirably, the printout 52 is printed on a suitable sheet of paper or the like. Alternately, the foot imaging device 14 can save the image to a computer (not shown) configured to display the image 54 of the scanned foot and measuring indicia 44 on a display monitor and/or store the image in a memory for later use.

By way of example, the following will describe a process for selecting a pair of shoes of a proper size using the foot measuring system 10. A person whose foot is to be measured places his or her foot into the fixture 30 so that the foot is adjacent the heel portion 49 of the shoe upper 32. The person adjusts the cuff 38 so that outside light is not introduced into the cavity 36 of the fixture 30. The imaging device 14 is operated by pressing one or more actuators 23 (e.g., operating buttons) to produce or display a printout 52 having the image 54 of the person's foot superimposed on the measuring indicia 44. The person then removes the foot from the fixture 30 and, optionally, repeats the process for the other foot. The printout(s) 52 thus produced will indicate the proper shoe size for that particular person. This printout 52 is used to select shoes of the appropriate size, either directly from a source of shoes, such as a display rack, or indirectly by placing an order with a sales person.

When introducing elements of the invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A system for measuring the size of a foot, the measuring system comprising:

a support surface having an opening therein;

a fixture positioned over the opening having a cavity suitable for receiving a foot to be measured; and an imaging device positioned relative to said opening to produce an image of a bottom surface of the foot superimposed on foot measuring indicia visually indicative of foot size.

2. The measuring system of claim 1 wherein the fixture is shaped like a shoe.

3. The measuring system of claim 2 wherein the fixture is a multicolored clown shoe.

4. The measuring system of claim 1 wherein the support surface has a transparent window covering the opening.

5. The measuring system of claim 4 wherein the foot measuring indicia comprises a scale indicating foot size imprinted on the window.

6. The measuring system of claim 1 wherein the imaging device is an optical scanner configured to produce the image by scanning the foot through the opening.

7. The measuring system of claim 6 wherein the image is a scanned image of the bottom surface of the foot and the foot measuring indicia.

8. The measuring system of claim 1 wherein said support surface comprises a raised platform above the imaging device, and wherein said system further comprises an actuator on the raised platform for operating the imaging device.

9. The measuring system of claim 1 wherein the fixture comprises a cuff configured fit snugly against the leg or ankle of the person whose foot is in the fixture to substantially prevent ambient light from entering the fixture.

10. The measuring system of claim 1 wherein said imaging device is operable to print said image.

11. The measuring system of claim 1 wherein said foot measuring indicia is a scale marked to indicate foot size.

12. The measuring system of claim 11 wherein said scale includes numbers corresponding to different foot size.

13. A system for measuring the size of a foot, the measuring system comprising:

a platform comprising a support surface having an opening therein;

an imaging device positioned relative to said opening to produce an image of a bottom surface of the foot superimposed on foot measuring indicia visually indicative of foot size; and an actuator on the platform for operating the imaging device.

14. The measuring system of claim 13 wherein the support surface has a transparent window covering the opening and the foot measuring indicia comprises a scale indicating foot size imprinted on the window.

15. A method of selecting a properly sized pair of shoes, said method comprising:

placing the foot of a person into a fixture positioned over a transparent window;

scanning a bottom surface of the foot through the window to produce an image of the foot superimposed on foot measuring indicia visually indicative of foot size;

printing said image; and using the image to select a properly sized pair of shoes.

16. A method of measuring the size of a person's foot according to claim 15 wherein the foot measuring indicia are marked on the window.

17. A method of measuring the size of a person's foot according to claim 15 wherein displaying the image comprises printing said image.

18. A method of measuring the size of a person's foot according to claim 15 wherein placing the foot includes placing the foot into a fixture shaped like a shoe.

19. A method of measuring the size of a person's foot, the method comprising:

placing the foot of a person into a fixture positioned over a transparent window;

scanning a bottom surface of the foot through the window to produce an image of the foot superimposed on foot measuring indicia visually indicative of foot size; and displaying said image.

20. A method of measuring the size of a person's foot according to claim 19 wherein the foot measuring indicia comprises a scale indicating foot size marked on the window.

21. A method of measuring the size of a person's foot according to claim 19 wherein displaying the image comprises printing said image.

22. A method of measuring the size of a person's foot according to claim 19 wherein placing the foot includes placing the foot into fixture shaped like a shoe.

* * * * *